US007178766B2

(12) United States Patent
Forshee et al.

(10) Patent No.: US 7,178,766 B2
(45) Date of Patent: Feb. 20, 2007

(54) RETAINER FOR IMMOBILIZING A BUCKET DURING MIXING

(76) Inventors: David J Forshee, 29 High Bluff Rd., Unit 2004, Hilton Head Island, SC (US) 29926; Gregory S. Forshee, 7374 River St., Benzonia, MI (US) 49616

( * ) Notice: Subject to any disclaimer, the term of this patent is extended or adjusted under 35 U.S.C. 154(b) by 59 days.

(21) Appl. No.: 10/649,276

(22) Filed: Aug. 26, 2003

(65) Prior Publication Data

US 2005/0045780 A1 Mar. 3, 2005

(51) Int. Cl.
*A47G 23/02* (2006.01)

(52) U.S. Cl. ..... 248/146; 366/349; 366/605

(58) Field of Classification Search ..... 248/146, 248/147, 310, 210, 148, 309.1, 311.2, 912, 248/907, 314, 346.03, 346.04, 128, 129, 248/910; 211/71.01; D3/315; D9/499; 220/737, 742, 630, 631, 628, 629; 215/393; D30/129, 130; D34/10, 9; 366/349, 605
See application file for complete search history.

(56) References Cited

U.S. PATENT DOCUMENTS 2,936,926 A * 5/1960 Miller ..... 220/571
3,590,988 A * 7/1971 Hollar ..... 206/776
3,642,239 A * 2/1972 Zeiler, Jr. ..... 248/210
D286,508 S * 11/1986 Tilden ..... D9/435
4,726,553 A * 2/1988 Wischusen, III ..... 248/146
4,998,696 A * 3/1991 Desjardins ..... 248/146
D383,271 S * 9/1997 Eshelman ..... D32/54
6,464,184 B1 * 10/2002 Lytle ..... 248/126
D474,404 S * 5/2003 Tropeano ..... D9/455

* cited by examiner

*Primary Examiner*—Gwendolyn Baxter
(74) *Attorney, Agent, or Firm*—Harness, Dickey & Pierce, P.L.C.

(57) ABSTRACT

A retainer for immobilizing a bucket containing a liquid material, such as paint or other relatively viscous liquids, during mixing the material or to prevent accidental tipping of the bucket, is formed with a ring-like socket within which the bucket is positioned. Laterally-extending wings are formed on the socket. The user stands upon the wings to hold the socket against the ground-supporting surface upon which the socket is supported so as to prevent rotational or other movement of the socket and, consequently, movement of the bucket. The socket is formed of a generally cylindrically-shaped, vertically-axised wall which is tapered inwardly from its upper edge to its lower edge at a sufficient slope to radially inwardly frictionally grip and temporarily lock the bucket within the socket. The outwardly extending wings are of sufficient size for supporting the user's feet on opposite sides of the socket so as to position the user generally above the bucket and enable the user to manually position and hold a mixing device in the bucket while the user's feet clamp the retainer, and consequently, the bucket, against the support surface.

7 Claims, 3 Drawing Sheets

RETAINER FOR IMMOBILIZING A BUCKET DURING MIXING

BACKGROUND OF THE INVENTION

This invention relates to a retainer which holds a large bucket or can containing liquid or other relatively viscous liquid materials, against rotational or other movement during the time that the liquid contents are mixed and, also, against tipping and spilling the contents. During the commercial procedures for applying paint or drywall "mud" or other coating or sealing materials, such as grout, stucco, mortar, wallpaper paste, cement and the like relatively viscous liquid materials, the person applying such materials typically obtains the materials in a conventional five-gallon or similarly sized container. Then the contents are mixed just before applying the liquid upon the desired surface. Such mixing may be performed manually with a stick-type stirrer of some sort. Alternatively, stirring may be performed with an electrically powered mixing device which has a motor-driven impeller that is inserted in the container for mixing purposes.

Conventionally, commercially used containers for such liquids are typically made in one or two standard sizes. Mixing the liquid contents of such containers may be necessary because, for example, the contents may have separated into two or more of their constituent ingredients. In some instances, separate ingredients, such as adding pigments or coloring materials might be added to the container. That requires mixing the contents before application.

In order to mix the contents of the container, the container is placed upon a surface, such as the ground or a suitable floor surface, and held manually while mixing the contents until they are sufficiently mixed for the application purposes.

However, a problem encountered in this conventional procedure, is that the mixing step normally causes a circular movement of the liquid, which is induced by the mixing device. That produces forces which cause the container to rotate or to otherwise move. This rotational movement or other movements while limited, nevertheless, interferes with the mixing and also may cause spilling or splashing of the contents during the mixing procedure. Moreover, at times such containers are inadvertently tipped over and their contents spilled out, during their use. Thus, it is desirable to clamp the container against any movement during the mixing procedure and during use, to prevent rotational or other movement. Further, it is desirable to hold the container against tipping over during times when the container is positioned for application of its contents, as well as during transit of the container.

In addition, it is desirable during the mixing operation, whether performed manually with a stirrer or mechanically with a power-driven impeller, to position the person who is operating a mechanical mixer above the open container for more conveniently holding and positioning the mixer within the container.

This invention contemplates providing a retainer which enables the user to clamp the liquid-containing bucket against rotation or other motion during mixing while simultaneously freeing the user's hands for holding the mixing device.

SUMMARY OF THE INVENTION

The invention herein contemplates providing a simple, very inexpensive, retainer which holds a container, such as a standard bucket or can containing, for example, liquid paint or other similar materials, against rotational or other movement during mixing of the contents of the container. The retainer frictionally and temporarily grasps the container while the retainer is clamped by the feet of the user against a support surface. This frees the user's hands so that the user may manually stir or hold a power driven stirrer within the container for conducting the mixing.

The retainer contemplated herein comprises a generally cylindrically-shaped, ring-like, socket into which a pail or can or bucket, can be inserted. By tapering or angling the interior wall surface of the ring-like socket with a Morse-like taper and/or by forming the interior wall of the ring of a resilient material, the socket ring applies a compressive, radially inwardly-directed force against the container to temporarily, tightly hold it within the socket.

The socket has laterally extending wings upon which the user may stand so that the body weight of the user clamps the retainer downwardly against the supporting ground or floor. Hence, the feet and weight of the user hold the socket, and consequently the container, against movement while freeing the hands of the user to manipulate either a manual stirrer or to position and hold a mechanical or electrically-operated stirrer for mixing. Although the container is rigidly held within the socket, it can be easily pulled upwardly out of the socket when the mixing is completed.

An object of this invention is to provide a simple, easily used, retainer for immobilizing the container against movement while positioning the user above the container and freeing the user's hands for manipulating the stirring device.

Another object of this invention is to provide a retainer which has no moving parts and which is easily transported, stored and kept available for immediate use when desired. Also, the retainer can be very easily cleaned of paint or other such materials. Having no moving parts and no separate locking mechanisms, the retainer can be almost instantly operated by being placed upon a floor or ground surface so that the user may step upon the extending wings to clamp the retainer against the support. Then the user may lift the container and insert it downwardly into the retainer ring. Thereafter the user may stir the contents manually or by inserting an electrical or mechanical mixing impeller in the container.

Still another object of this invention is to provide a retainer for holding containers while mixing their contents, such as paint and other liquid materials, which retainer is so inexpensive to manufacture that it can be either freely given away along with the purchase of the contents or it can be provided to tradesmen at extremely low costs and can be discarded after use in the event of damage or contamination.

These and other objects and advantages of this invention will become apparent upon reading the following description, of which the attached drawings form a part.

DETAILED DESCRIPTION OF THE PREFERRED EMBODIMENTS

Figure 1:
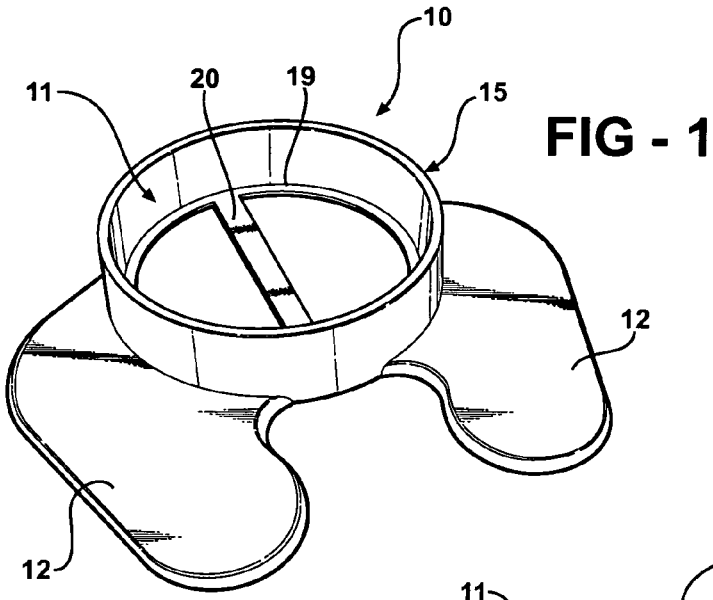
FIG. 1 illustrates the retainer in perspective.

Referring to the drawings, the retainer, generally designated 10, is formed with a socket portion 11 and laterally extending wings 12. The socket portion is formed of a vertically axised ring 15 which, in preferred embodiment, is comprised of an inner wall 16 and an outer wall 17. The walls are thin and are joined along their upper edges 18. Preferably, the entire retainer structure, including the walls and wings, is formed of a one-piece molded, slightly resilient plastic material. Thus, the thin inner wall, along with the hinge-like integral connection between the walls permit a limited resilient contraction and expansion for holding or inserting and removing a container within the ring. The particular plastic utilized may vary, depending upon availability, cost, moldability, etc. Such selection can be made by one skilled in the art based upon the availability of commercially suitable plastics for this purpose.

Figure 5:
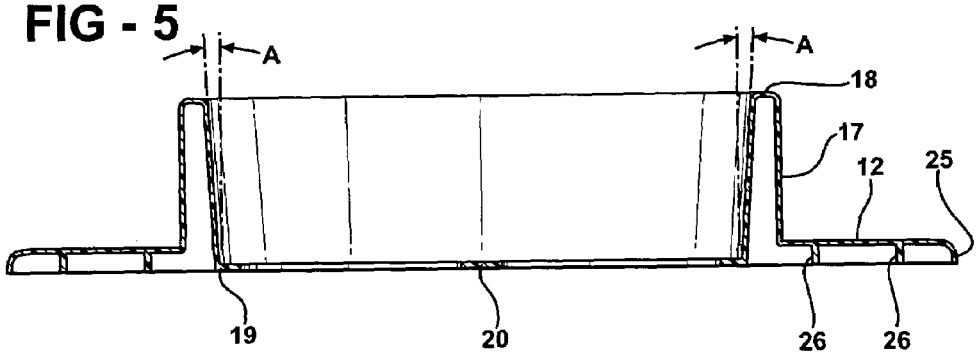
FIG. 5 is an enlarged, cross-sectional view of the retainer taken in the direction of arrows 5—5 of FIG. 2.
Figure 6:
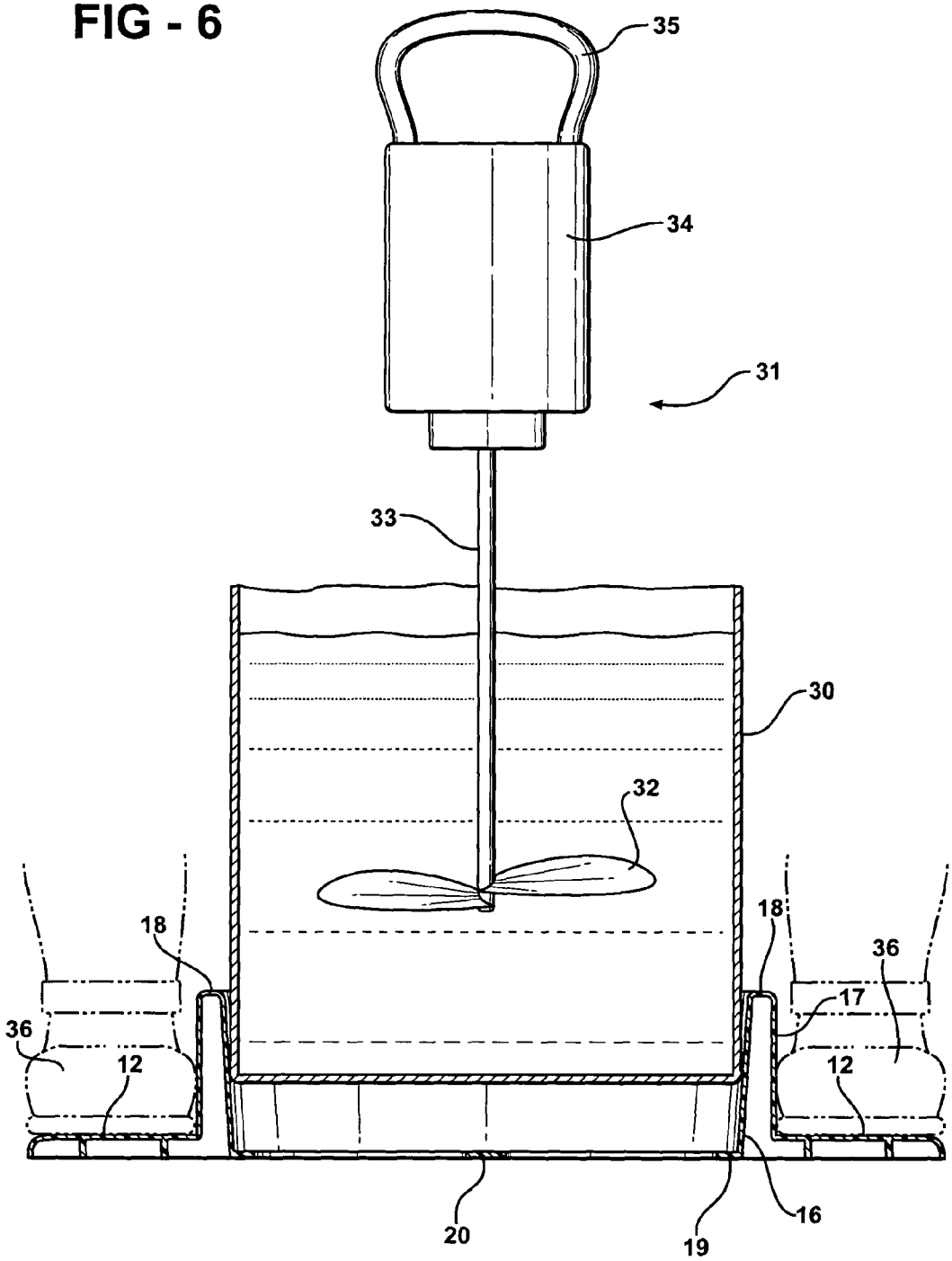
FIG. 6 is a cross-sectional view illustrating the insertion of a bucket, such as used for containing paint, in the retainer. The feet of the user are schematically illustrated as positioned upon the laterally-extending wings of the retainer. An electrically-operated impeller-type mixer is positioned in the bucket.

The inner wall 16 is provided at its lower edge with an inwardly extending flange 19 (see FIGS. 5 and 6). Also, a cross-brace 20 may be provided to stabilize and reinforce the ring shape of the inner wall.

Figure 2:
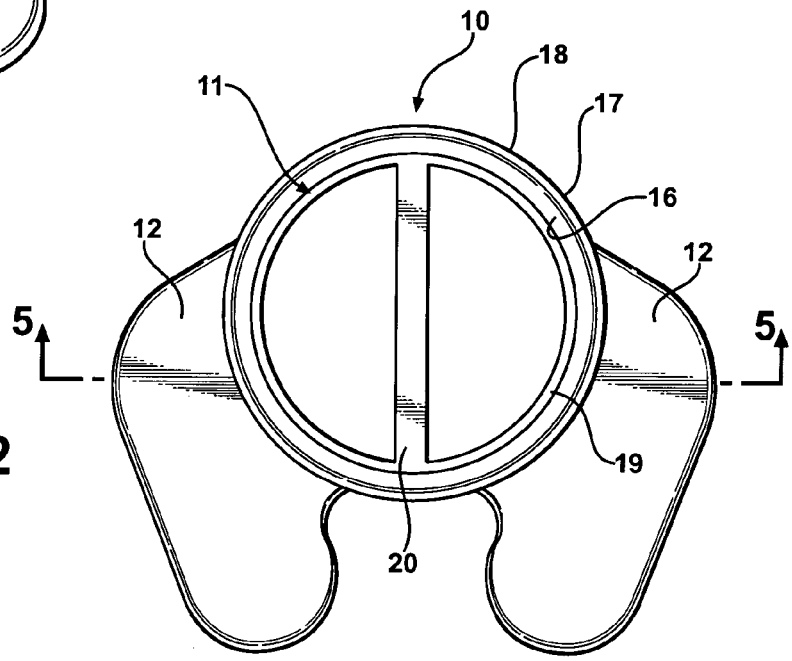
FIG. 2 is a top, plan view of the retainer.
Figure 3:
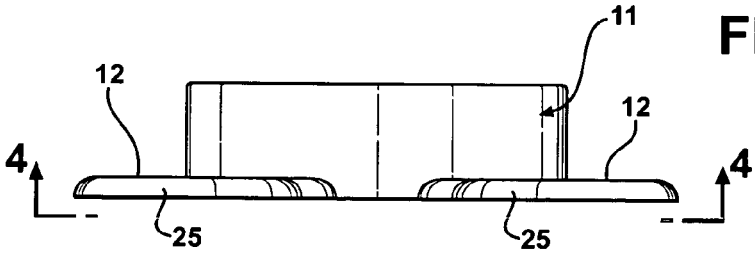
FIG. 3 is a front elevational view of the retainer.
Figure 4:
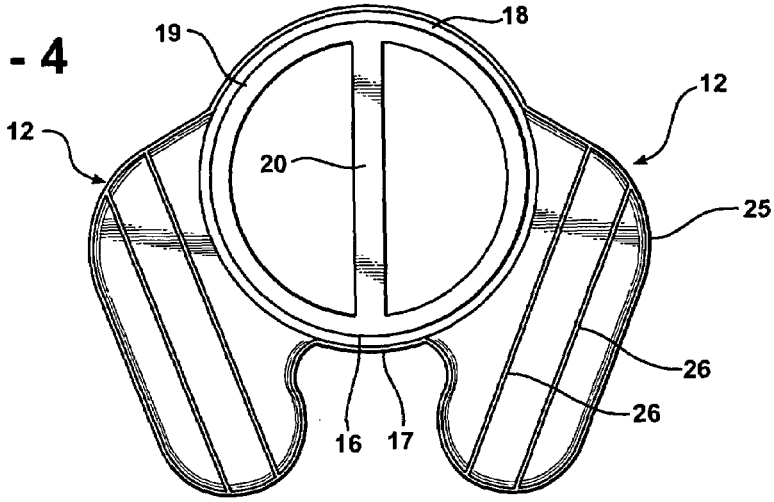
FIG. 4 is a bottom, plan view of the retainer taken in the direction of arrows 4—4 of FIG. 3.

The outer wall 17 is provided with the laterally outwardly extending wings 12. The shape of the wings, which is illustrated in FIG. 2, generally consists of flat upper surface projections upon which the user's feet may be placed during mixing operations. However, although a pair of outwardly extending wings is preferred, it is contemplated that a single wing might be used or, alternatively, the wing may be a flat, continuous, laterally extending projection encircling all or part of the socket so that the user may position his or her feet anywhere around the periphery of the socket.

The wings 12, or if only one continuous or discontinuous wing is utilized, preferably has a downwardly-extending edge flange 25 integral with its outer periphery. The wing or wings may also be provided with downwardly extending protuberances or ribs 26. The ribs tend to frictionally grip against ground surfaces, such as the dirt-like surfaces of the ground surrounding a house which is being painted. Similarly, the edge flange 25 may also serve to grip against a support surface, as well as reinforce and stiffen the wings.

The inner wall 16, as described above, is preferably formed with its inner surface arranged at a Morse-type taper. "Morse" tapers are used in machinery for temporarily holding a shaft or the like within a collet or clamp. In this case, the Morse-type taper engages a circular can or bucket to temporarily lock the bucket or container within the socket by simply inserting the can or container downwardly into the socket to the point where the periphery of the container engages and is locked against the inner surface of the wall. The slight resiliency of the wall assists in locking the container to the wall by yielding slightly as the can is inserted and then forming compressive, radially inwardly-directed forces against the surface of the container. Removal of the container from the socket is simply a matter of lifting it upwardly with sufficient manual force to pull the container from the socket. The removal step may be facilitated by gently moving the container from side to side to break loose the lock formed by the taper. That allows the container to be easily lifted up from the socket.

Although the angle "A" (see FIG. 5) of the taper or slope of the inner surface of the inner wall may vary, depending upon the particular size of the container relative to the size of the socket, a typical "Morse" taper of about 2 degrees on the inner wall surface is preferable. This taper provides a slope angle of about 4 degrees when the opposite diametrically located portions of the circular ring are considered. This approximate slope should accommodate a conventional five-gallon paint bucket or can having a standard outside diameter of approximately 10⅞ inches.

In operation, a bucket or pail or can, such as a standard 10⅞ inch diameter can 30, is inserted downwardly into the socket until it frictionally locks within the socket. The terms "bucket," "pail" and "can" are used interchangeably herein to refer to a conventional container such as is used for paint or other similar liquids.

As illustrated in FIG. 6, an electrical mixer 31, having a mixing impeller 32 which is attached to a shaft 33 driven by a motor 34, can be positioned over and inserted into the liquid contents of the bucket. The user may manually grip the handle 35 on the mixing device 31 to hold the mixer. At the same time, the user can position his or her feet 36 upon the wings on opposite sides of the socket. That will automatically position the user's body over the upper end of the bucket and position the mixer downwardly into the bucket.

The user may use a conventional electrically-operated mixer or may simply reach down into the bucket with a suitable wand or stick or brush to stir the contents of the bucket. In either case, the user's body is positioned over the can at a convenient location for the mixing purpose.

Figure 7:
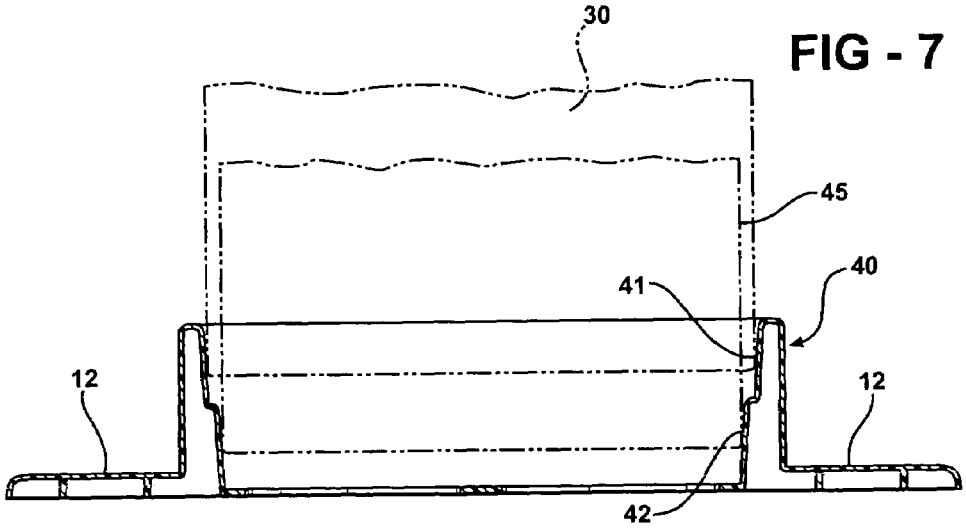
FIG. 7 illustrates, in cross-section, a modified retainer having two different diameter, coaxial socket portions for insertion of two different size buckets or cans.

Because there may be buckets or cans of a slightly different standard diameter, such as a 10¼ inch diameter or the like, the interior wall of the retainer may be varied accordingly. In addition, the wall may be modified, as illustrated in FIG. 7, to secure more than one size container. The modified retainer 40, in the illustration, is provided with two co-axial sockets, namely, an upper socket 41 for the larger, such as 10⅞ inch diameter standard cans, and a lower socket 42 which may be sized for a smaller conventional sized can such as 10-¼ or 10⅛ inch diameter.

FIG. 7 schematically illustrates a larger bucket 30, shown in dotted lines, positioned within the upper socket and a smaller diameter bucket 45, shown in dotted lines, arranged within the lower socket 42.

Additional sockets may be provided within the retainer ring by providing more, different diameter, socket portions, one above the other. Each socket may be slightly smaller in diameter than the socket above it.

While the foregoing description illustrates a preferred embodiment of this invention, this invention may be further developed within the scope of the following claims. Accordingly, having fully described an operative embodiment of my invention, I now claim:

1. A retainer for immobilizing a bucket against rotational and other movements during a time that material contained within the bucket is mixed, comprising:

a retainer ring having a vertical axis which forms a cylindrically-shaped socket into which the bucket may be placed; with the ring having a forward portion, diametrically opposite side portions and a rear portion;

a laterally outwardly extending, generally flat wing formed on each of the opposite side portions of the ring;

each wing extending along that wing's respective ring side portion rearwardly of the ring a sufficient distance for supporting a foot of a user of the retainer which is positioned upon said wing so that the feet of the user are on opposite sides of the ring rear portion and the user's body is arranged upright and generally parallel to, and spaced rearwardly of, the vertical axis of the ring, and the body of the user is generally rearwards of said rear portion of the ring whereby a mixer held by the user will extend substantially vertically downwardly approximately into the center of a bucket arranged within the ring;

said ring having an interior, circularly-shaped wall surface having upper and lower edges, which taper downwardly and inwardly from the upper to the lower edges, relative to the axis of the ring, with the diameter of the upper edge being adapted to be larger than the anticipated diameter of the bucket and the diameter of the lower edge, and the diameter of the lower edge being adapted to be smaller than the anticipated diameter of the bucket;

whereby the bucket containing material to be mixed is inserted in the socket so that the bucket engages and frictionally locks to portions of the inner surface of the wall, and the user of the retainer may step upon the wings to firmly press the wings and, thereby, hold the retainer, against a surface upon which the retainer may be positioned, and to position the user generally over the bucket so that the user may insert and hold the mixing device in the bucket for mixing the material while simultaneously holding the bucket against rotational or other movements that might otherwise have occurred if the bucket were free to move;

and the interior wall of the ring being formed with at least two coaxial upper and lower generally cylindrically shaped tapered portions, with the upper cylindrically shaped tapered portion being of a larger diameter than the lower cylindrically shaped tapered portion, and thereby forming different diameter socket portions, so that at least two different diameter buckets may be engaged by, and retained within, the socket portions within which the bucket more closely fits.

2. A retainer for immobilizing a bucket, during the time that the contents of the bucket are mixed, or to prevent accidental tipping or rotation of the bucket, comprising:

a ring having a vertical axis formed of two thin, concentric, generally cylindrically-walls joined together along their upper edges and being free of each other at their lower edges to thereby form a circular socket having inner and outer walls; and with the ring having opposite side portions and a rear portion;

said inner wall having an inner wall surface that is tapered downwardly and radially inwardly from the upper edge to the lower edge of said wall surface and being of a diameter to receive and hold a predetermined size bucket with the bucket engaging the inner wall inner surface and being frictionally gripped by the inner wall;

said outer wall having radially outwardly extending wing portions thereon and forming foot supports on opposite sides of the ring, with each wing having a generally flat, horizontal, upper surface of a size to accommodate a foot of a user of the retainer for pressing down and clamping the respective wing down against a support surface on which the retainer is positioned and with the wing portions extending from about their respective ring side portions rearwardly of the ring a sufficient distance to underlay the user's foot and the wings converging towards each other at an angle for positioning the user's feet at a diverging angle along the rear and side portions of the ring with the user's body generally adjacent the rear portion of the ring for holding a mixer generally in front of the user's body down into the ring and, thereby, preventing movement of the retainer relative to the support surface and correspondingly holding the bucket inserted within the retainer socket against movements during the time the contents of the retainer are mixed.

3. A retainer as defined in claim 2, and with the interior surface of the interior wall defining the socket being provided with a taper of a slope angle which frictionally locks the bucket to said wall surface for preventing the bucket from rotational movement during the mixing.

4. A retainer as defined claim 3, above, and including said taper being approximately 2 degrees so as to provide an approximately 4 degree-taper for diametrically opposite surfaces of the socket.

5. A retainer as defined in claim 2, above, and including said retainer being formed of a slightly resilient plastic material so that the inner wall of the socket expands outwardly slightly upon insertion of the bucket into the socket and, therefore, exerts a radially inwardly directed force which grips the bucket radially inwardly and holds the bucket against rotational movement within the socket.

6. A retainer as defined in claim 2, and with the interior wall of said ring being formed with at least two coaxial upper and lower, generally cylindrically-shaped, tapered portions with the upper cylindrically-shaped tapered portion being of a larger diameter than the lower cylindrically-shaped tapered portion, to thereby form upper and lower socket portions of different diameters whereby at least two different sized buckets may be inserted within and retained within the particular socket portion within which each bucket most clearly fits.

7. A retainer for immobilizing a bucket against rotational and other movements during a time that material contained within the bucket is mixed, comprising:

a retainer ring having a vertical axis which forms a cylindrically-shaped socket into which the bucket may be placed: with the ring having a forward portion, diametrically opposite side portions and a rear portion;

a laterally outwardly extending, generally flat wing formed on each of the opposite side portions of the ring;

each wing extending alone that wing's respective ring side portion rearwardly of the ring a sufficient distance for supporting a foot of a user of the retainer which is positioned upon said wing so that the feet of the user are on opposite sides of the ring rear portion and the user's body is arranged upright and generally parallel to, and spaced rearwardly of, the vertical axis of the ring, and the body of the user is generally rearwards of said rear portion of the ring whereby a mixer held by the user will extend substantially vertically downwardly approximately into the center of a bucket arranged within the ring;

said ring having an interior, circularly-shaped wall surface having upper and lower edges, which taper downwardly and inwardly from the upper to the lower edges, relative to the axis of the ring, with the diameter of the upper edge being larger than the anticipated diameter of the bucket and the diameter of the lower edge, and the diameter of the lower edge being smaller than the anticipated diameter of the bucket;

whereby the bucket containing material to be mixed is inserted in the socket so that the bucket engages and frictionally locks to portions of the inner surface of the wall, and the user of the retainer may step upon the wings to firmly press the wings and, thereby, hold the retainer, against a surface upon which the retainer may be positioned, and to position the user generally over the bucket so that the user may insert and hold a mixing device in the bucket for mixing the material while simultaneously holding the bucket against rotational or other movements that might otherwise have occurred if the bucket were free to move;

and the interior wall of the ring being formed with coaxial upper and lower generally cylindrically shaped tapered portions, with the upper portion being of a larger diameter than the lower portion for forming different diameter socket portions for receiving and retaining different diameter buckets.

* * * * *